United States Patent [19]

Dewhirst

[11] 3,999,577

[45] Dec. 28, 1976

[54] APPARATUS FOR MAKING AXMINSTER CARPETS

[75] Inventor: Geoffrey Wilson Dewhirst, Broughty Ferry, Scotland

[73] Assignee: Thompson Shepherd & Co. Ltd., Dundee, Scotland

[22] Filed: Feb. 13, 1975

[21] Appl. No.: 549,626

Related U.S. Application Data

[63] Continuation-in-part of Ser. No. 457,683, April 3, 1974, abandoned, which is a continuation of Ser. No. 249,982, May 3, 1972, abandoned.

[52] U.S. Cl. ..... 139/7 R

[51] Int. Cl.[2] ..... D03D 39/08

[58] Field of Search ..... 139/3–7 R, 139/7 A–7 G

[56] References Cited

UNITED STATES PATENTS

| | | | |
|---|---|---|---|
| 3,187,779 | 6/1965 | Smiley et al. | 139/7 |
| 3,521,676 | 7/1970 | MacIsaac et al. | 139/6 |

FOREIGN PATENTS OR APPLICATIONS

| | | | |
|---|---|---|---|
| 1,286,138 | 8/1972 | United Kingdom | 139/7 R |
| 416,674 | 9/1934 | United Kingdom | 139/7 D |

*Primary Examiner*—James Kee Chi

*Attorney, Agent, or Firm*—Alan H. Levine

[57] ABSTRACT

Apparatus for weaving a plain or patterned Axminster pile carpet, wall carpet, floor rug, or mat in which the pile is produced by carrying selected tufts of pile yarn from a yarn feed position to the weaving point by a gripper, and in which at least two distinct heights of pile are produced in an infinitely variable pattern within the normal limitations of the loom.

6 Claims, 9 Drawing Figures

38
36
32
40
42
44
56
46
48
34
76
72
58
51
66
61
50
60
52
28
62
54
64
78
68
83
89
86
74
87
91
88
30
80
12
84
10
16
90
24
93
20
14
18
22
26

APPARATUS FOR MAKING AXMINSTER CARPETS

This is a continuation-in-part of application Ser. No. 457,683 filed 3rd Apr., 1974, which is a continuation of application Ser. No. 249,982 filed 3rd May, 1972, now both abandoned.

This invention relates to a method of manufacturing an Axminster pile carpet having two different heights of pile. More particularly the invention is concerned with the production on a gripper loom of an Axminster carpet having two different pile heights.

The term carpet as used herein is intended to include any floor covering having a pile produced by the gripper Axminster process.

The gripper principle of making Axminster carpets which was developed in the United Kingdom in about 1890 by Britons of Kidderminster, England and with which the present invention is concerned is not to be confused with the spool-gripper method which has normally been preferred in the United States of America. In a gripper Axminster loom yarn carriers are provided for the supply of pile yarns, the operation of the yarn carriers preferably being controlled by a Jacquard. Thus in accordance with a Jacquard programme the yarn carriers, each of which normally carries a number of pile yarns of different colour are lifted so that the selected pile yarn in each carrier is located at a predetermined location. The loom also comprises a set of grippers, one for each yarn carrier, arranged to revolve about a semicircle between the yarn carriers and the fell of the foundation structure of the carpet. After the yarn carriers have been lifted in accordance with the Jacquard programme, the grippers close on the selected pile yarns, nipping the ends of the yarns. There is then a relative movement between the yarn carriers and the grippers, usually accomplished by movement of the yarn carriage in which the carriers are mounted away from the grippers so that a length of pile yarn is drawn-off each carrier. A knife or set of knives then traverses across the loom to sever the drawn-off pile yarn leaving the grippers each holding a short length of pile yarn. These short lengths or tufts of pile yarn are then inserted in the carpet backing by rotation of the grippers to lay the tufts against the fell of the backing. A binder weft is then inserted and at the same time the jaws of the grippers open to release the tufts. Thereafter the carriage, carriers and grippers return to their initial positions and the cycle is repeated.

As indicated above all this is well known and has been described in a number of publications, for example "Carpets" by R. S. Briton published by Sir Isaac Pitman & Sons Ltd., London 1948 and "Carpets and other textile floor coverings" by George Robinson published by Textile Book Service. Furthermore, an arrangement by which the yarn carriers in a gripper loom are lifted to present selected pile yarn ends to the grippers is described in Britons British Pat. No. 15,680 dated 3rd Oct., 1890.

It will be evident from the above description of the prior art that the length of the tufts for each cycle of the loom is the same so that a carpet woven on a conventional gripper Axminster loom has a uniform pile height. It is the object of the present invention to enable carpet of two different heights of pile to be woven on a conventional gripper Axminster loom by appropriate modification of the loom.

Accordingly the present invention provides a method of weaving a carpet on a gripper Axminster loom, said loom comprising a plurality of pile yarn carriers mounted on a yarn carriage, a plurality of grippers corresponding in number to the yarn carriers and said yarn carriage being movable relative to the grippers, the improvement wherein for alternate pile forming picks the relative movement between the yarn carriage and grippers is greater than for the other pile forming picks whereby tufts of pile yarn drawn from said yarn carriers by the said relative movement of yarn carriage and grippers are longer in said alternate pile forming picks than tufts formed in the other pile forming picks.

The term pile forming pick as used herein means that pick of the foundation structure where tufts are inserted. The normal practice in Axminster carpet weaving by the gripper method is to insert tufts every three picks, i.e. 3 shot weaving although in some cases tufts are inserted every two picks, i.e. 2 shot weaving.

A specific embodiment of the invention will now be described by way of example with reference to the accompanying drawings, in which.

In order to carry out the invention a conventional gripper Axminster loom is modified as will be described with reference to FIGS. 1, 1A and 8. The modifications to the loom only involve means for regulating movement of the yarn carriage and movement of the grippers, the rest of the loom being entirely conventional. For that reason only parts of the loom relevant to the invention are described in detail. The parts of the loom not described are however well known.

Figure 1:
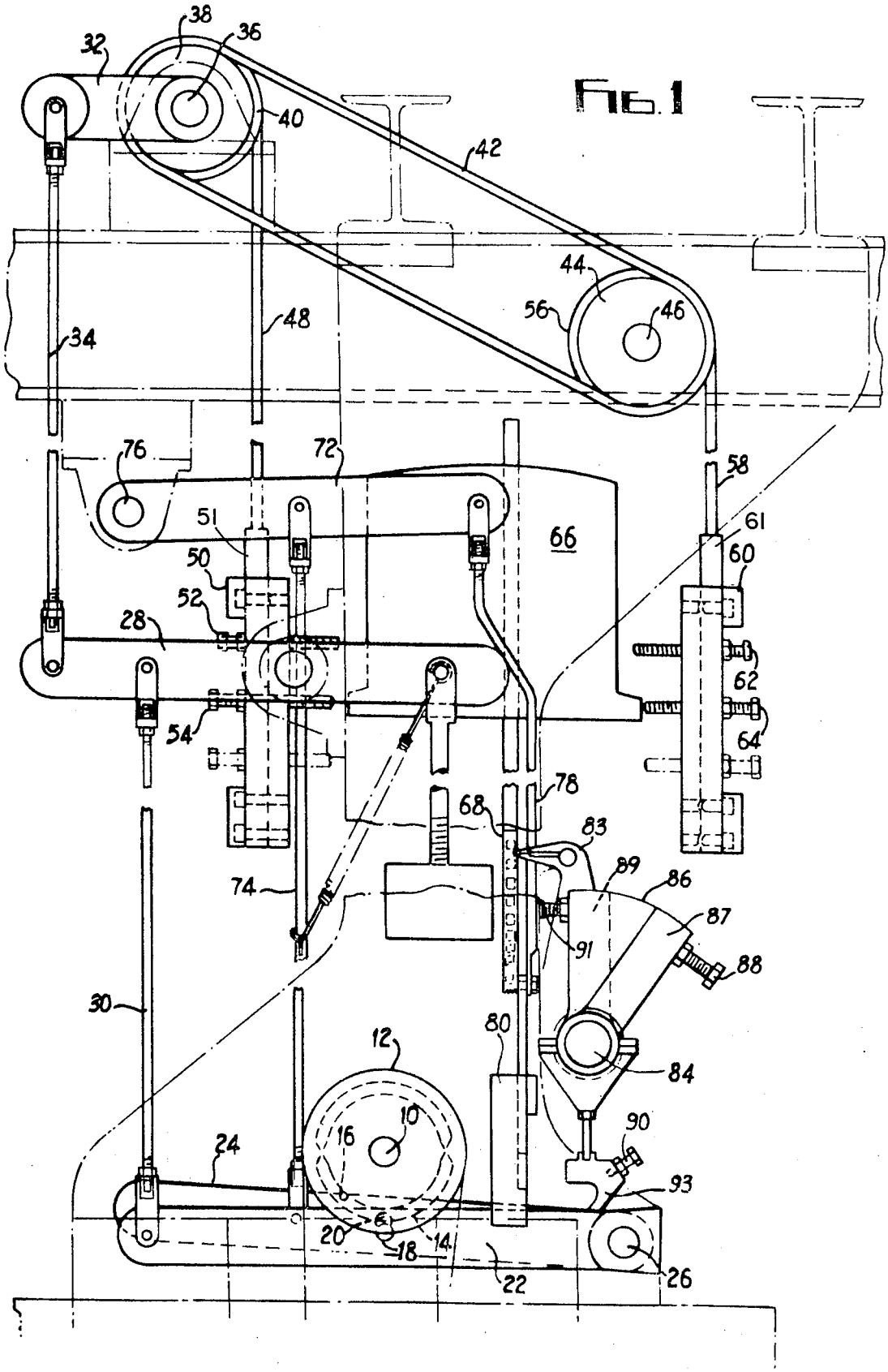
FIGS. 1 and 1A show diagrammatically and in side elevation a loom for carrying out the method of the present invention.
Figure 1A:
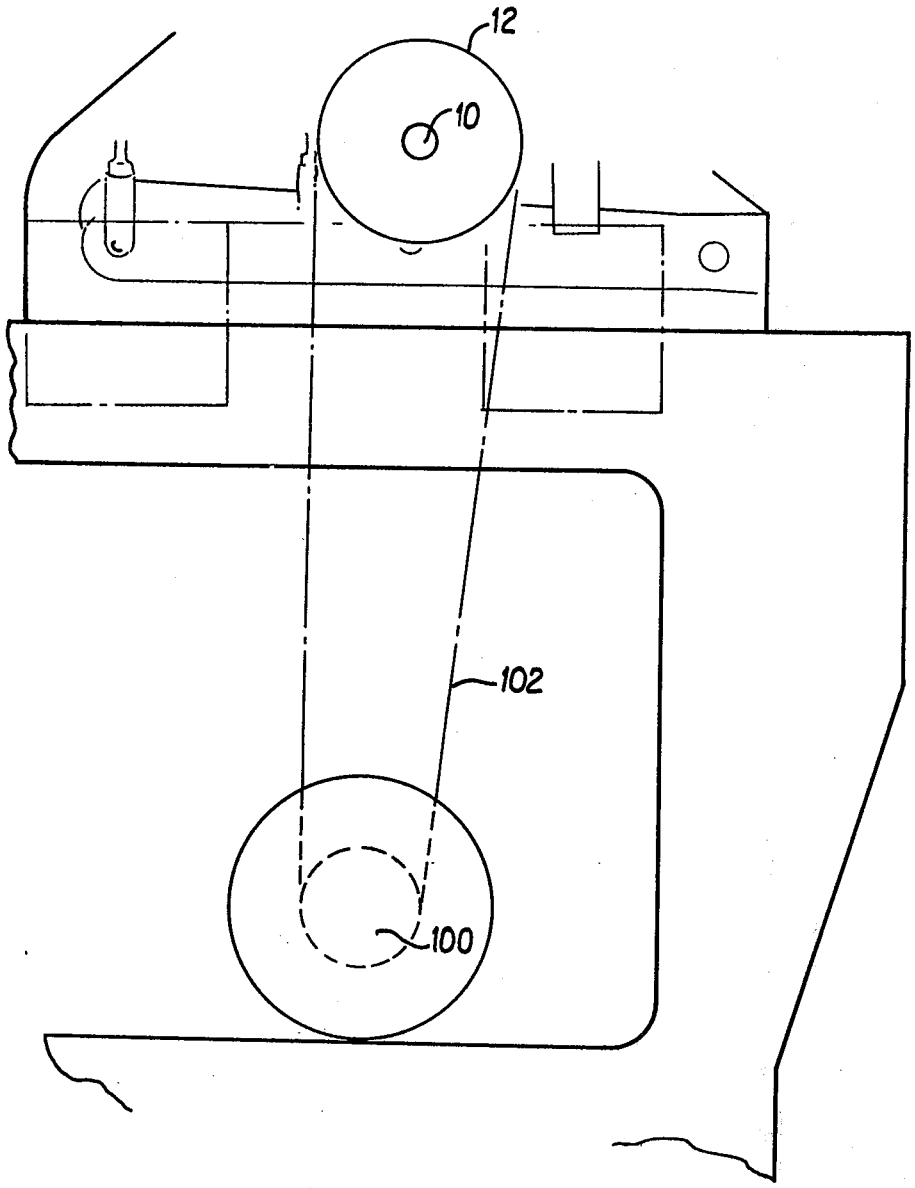
Figure 8:
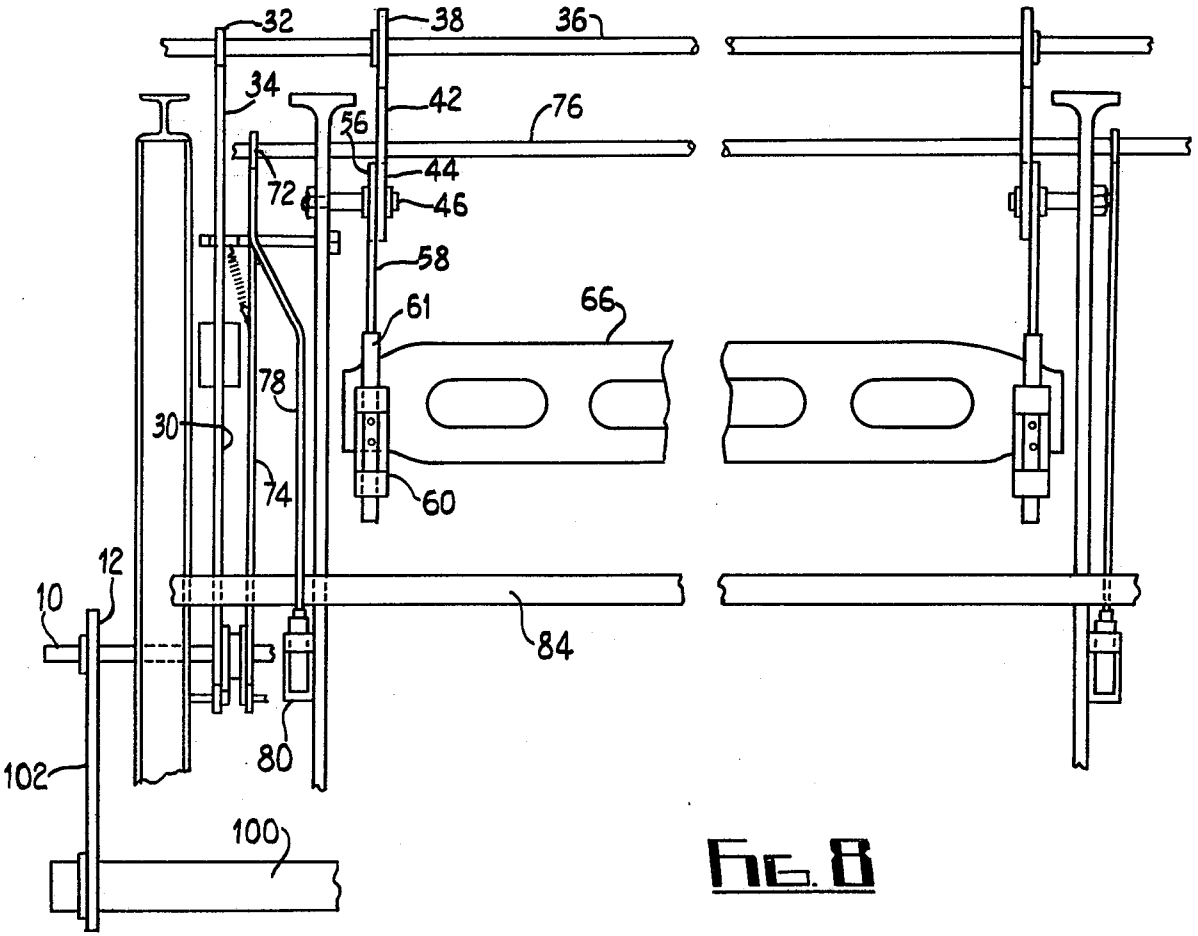
FIG. 8 is a diagrammatic end view of the loom of FIG. 1.

Referring to FIGS. 1, 1A and 8 a supplementary cam shaft 10 is mounted on the shuttle side of a loom (not shown but which is known per se) and is arranged to be driven at one-sixth the speed of the main shaft 100 of the loom through a pulley 12, mounted on the cam shaft 10, and an endless belt 102. Cams 14 and 16 are mounted on the cam shaft 10, said cams acting on anti-friction runners 18 and 20 fixed to levers 22 and 24 respectively, both levers 22 and 24 being pivotally mounted at one end as at 26.

Lever 22 is coupled to a lever 28 by means of a connecting rod 30 pivotally connected to both levers 22 and 28 and lever 28 is coupled to one end of a lever 32 by means of connecting rod 34 pivotally connected to both levers 28 and 32. The other end of lever 32 is fixed to a shaft 36 which carries pulleys 38 and 40. An endless belt 42 links pulley 38 with a pulley 44 mounted on shaft 46 and a flexible linkage 48 is fixed to pulley 40. The other end of linkage 48 carries a stop member 50 which includes two adjustable stops 52 and 54. A second pulley 56 on shaft 46 has a flexible linkage 58 attached thereto which carries a second stop member 60 having adjustable stops 62 and 64.

The stop members 50 and 60 are confined to vertical movement for example by sleeve (not shown) fixed to the loom frame and surrounding the upper parts 51 and 61, respectively of the stop members.

The movement of the yarn gripper is controlled by movements of lever 24 which is connected to a lever 72 by a connecting rod 74 pivotally coupled to levers 24 and 72. Lever 72 is itself pivotally mounted at one end 76 and at the other end has a rod 78 pivotally mounted thereon, the rod 78 carrying a stop abutment member 80. The grippers, one of which 83 can be seen in FIG. 1, are mounted upon a gripper shaft 84, as in conventional looms.

A wedge shaped bracket 86 is mounted on shaft 84 for rotation therewith. The bracket has a flange 87 on one side and adjacent one edge thereof and a second flange 89 on the opposite side and adjacent the other edge of the bracket. An adjustable stop member 88 is fixed to, and projects from flange 87 and an adjustable stop member 91 is fixed to and projects from flange 89. A further adjustable stop 90 is mounted on an abutment 93 on the loom frame. The stop 90 and abutment 93 lie in the plane of flange 89 on the bracket 86 so that, on rotation of the gripper shaft 84 flange 87 and stop 88 thereon do not engage the stop 90 or abutment 93. The purpose of this arrangement will become apparent from the description of the operation of the method of the invention which now follows.

For the production of high pile the cams 14 and 16 are in the positions shown in FIG. 1 so that lever 22 is depressed and lever 24 is lifted due to the action of spring 92 connected between lever 28 and connecting rod 74. The aforesaid movement of levers 22 and 24 causes anticlockwise movement of shaft 36 which causes a correponding anticlockwise movement of shaft 46. Stop members 50 and 60 are therefore lifted so that the movement of the yarn carriage 66 is limited by the short stops 54 and 64, i.e. there is maximum movement of the yarn carriage which thereby allows the grippers to obtain a long tuft from the yarn carriers one of which 68 is shown in FIG. 1.

Figure 2:
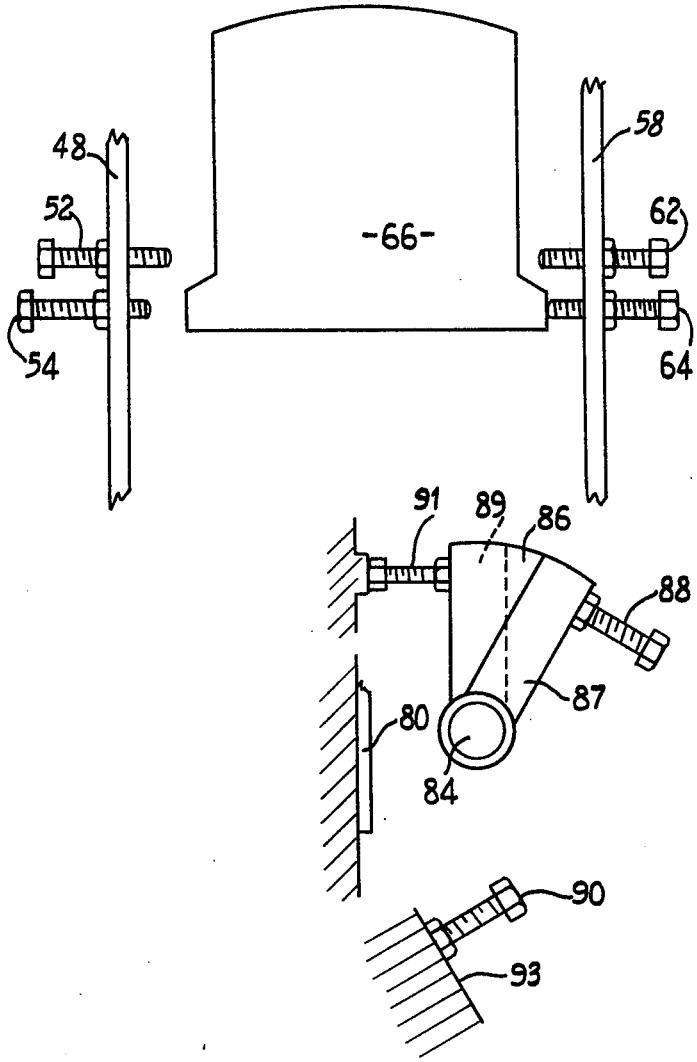
FIGS. 2, 3 and 4 show diagrammatically the sequence of operations performed by the yarn carriage and stops on the gripper shaft during the production of long pile tufts.
Figure 3:
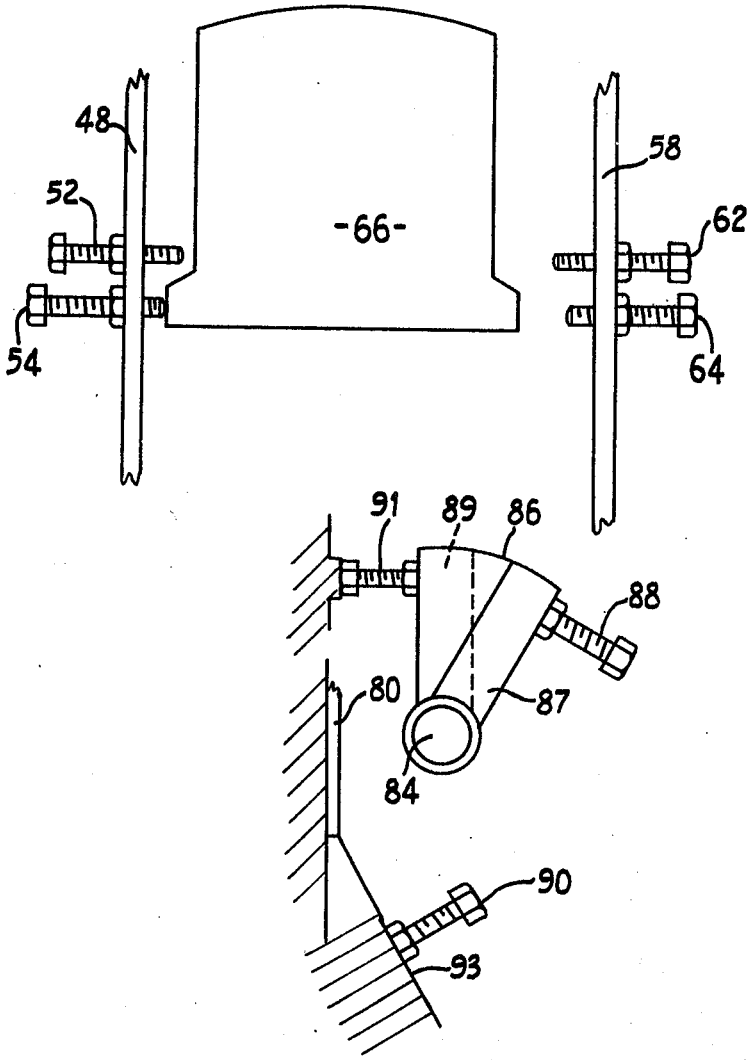

This is shown more clearly in FIGS. 2 and 3. In FIG. 2 the yarn carriage is in contact with short stop 64 at which stage the grippers close onto selected yarns presented thereto on the yarn carriers. The yarn carriage now moves away from the grippers and into contact with short stop 54 (FIG. 3) so that yarn is drawn off the carriers. As in conventional looms the yarn drawn off the carriers is now severed by a knife leaving the grippers holding one end of the yarn tufts.

Figure 4:
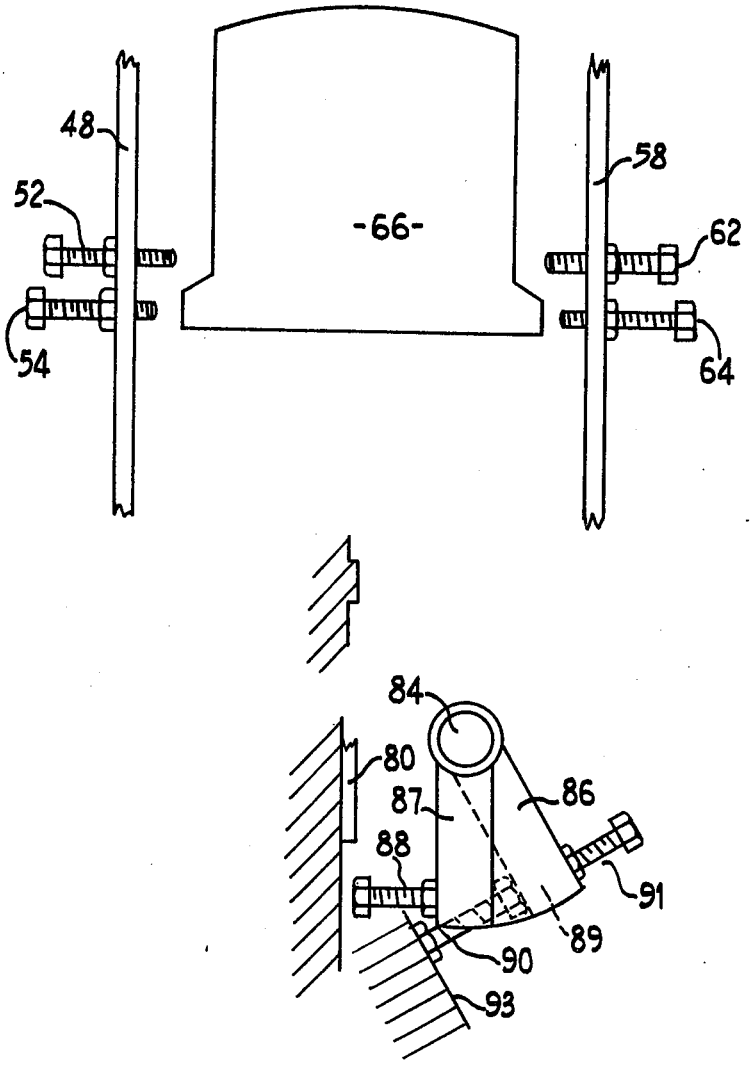

The gripper shaft now rotates clockwise as viewed in FIG. 1 until, as shown in FIG. 4, the stop 90 engages the side of flange 89 remote from stop 91. As in conventional looms this movement of the grippers lays the tufts into the foundation structure of the carpet whereupon the grippers open to release the tufts and the gripper shaft rotates anticlockwise to return the grippers to the position where they can accept further yarn from the yarn carriers.

On the next cycle of the loom the cams 14 have rotated from the position shown in FIG. 1 through 180°. Thus lever 22 is lifted and lever 24 depressed. Shafts 36 and 46 now rotate clockwise so that stop members 50 and 60 are lowered to bring long stops 52 and 62 into the path of movement of the yarn carriage. The movement of the yarn carriage is thus reduced so that the gripper only obtains a short tuft from the yarn carrier.

Figure 5:
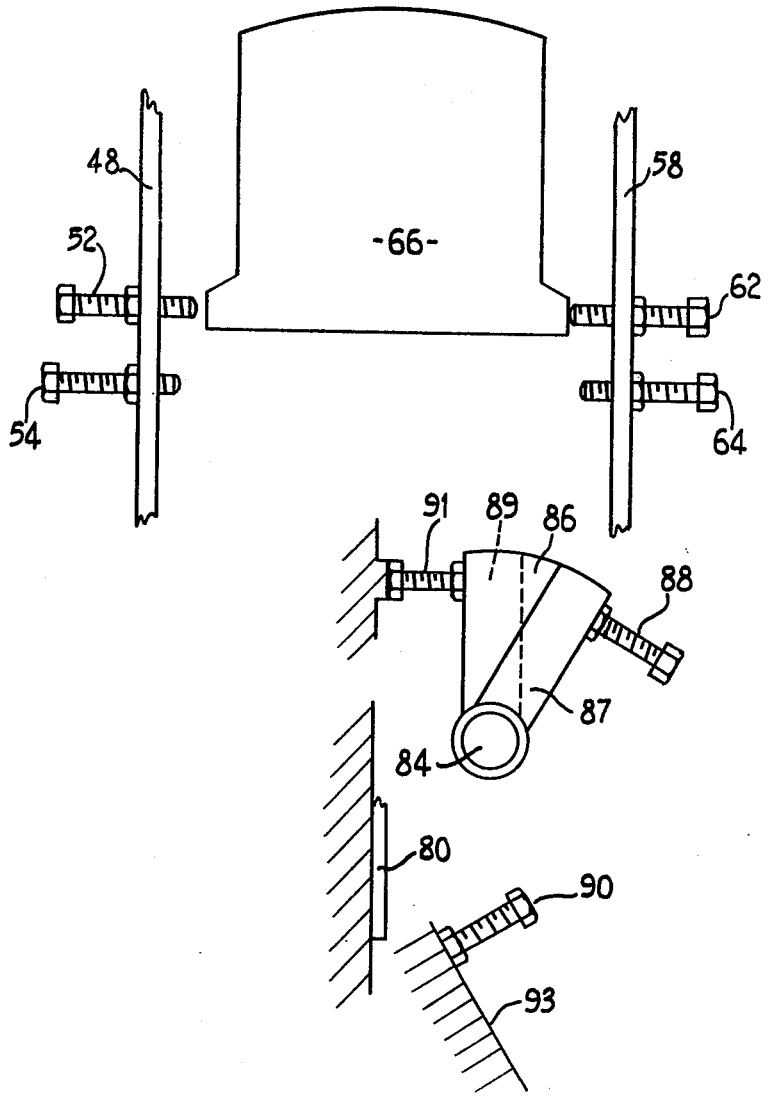
FIGS. 5, 6 and 7 show diagrammatically the sequence of operations performed by the yarn carriage and stops on the gripper shaft during the production of short pile tufts.
Figure 6:
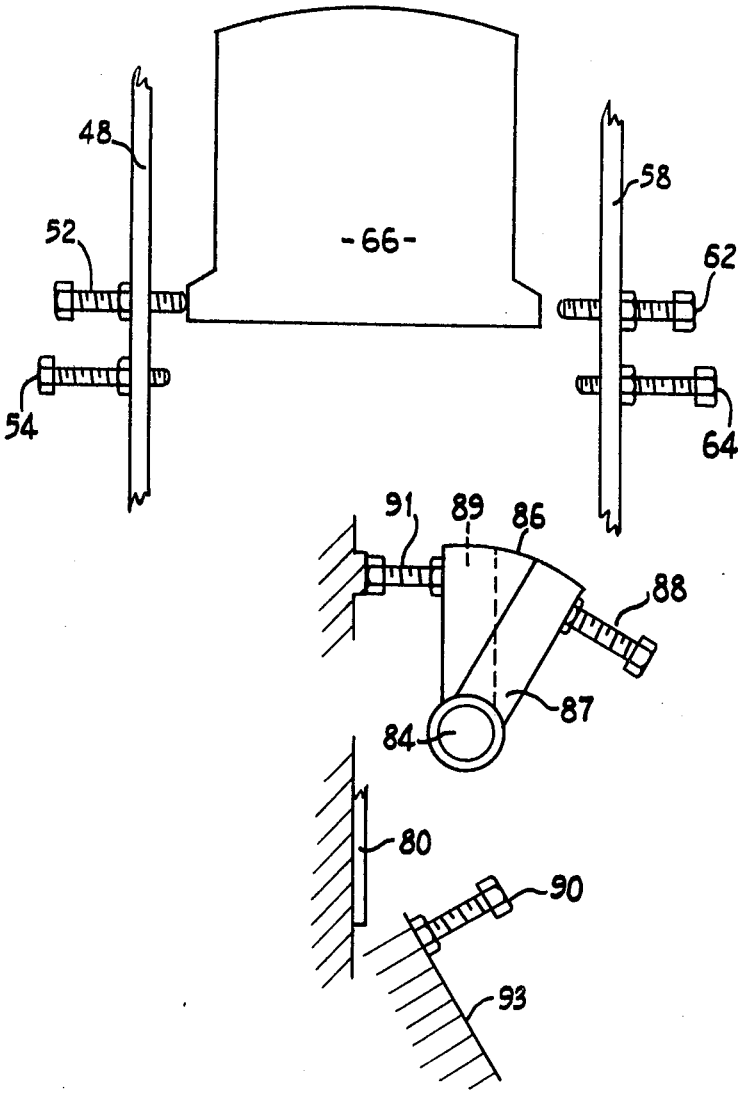

Thus in more detail FIG. 5 shows the position of the yarn carriage in engagement with long stop 62 when the grippers close on yarn presented thereto by the yarn carriers. The yarn carriage now moves away from the grippers until it engages long stop 52 (FIG. 6). This movement is much less than in the preceding loom cycle and hence the length of yarn drawn off the yarn carriers is less.

Figure 7:
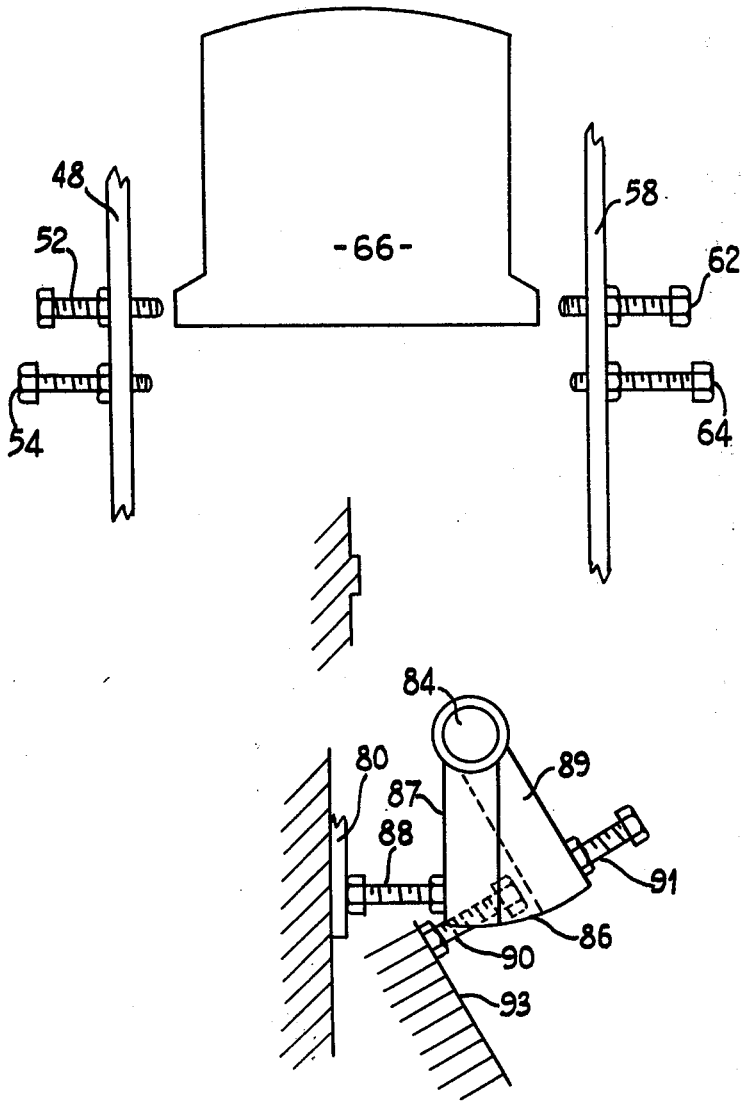

As before the tufts are severed and the gripper shaft rotates clockwise to insert the tufts in the foundation structure of the carpet. However on this occasion simultaneously with the lowering of members 50 and 60 the lever 72 is rotated clockwise to lower stop abutment member 80, so that the clockwise rotation of the gripper to the weaving position is limited by the engagement on the stop abutment member 80 of long stop 88 mounted on flange 87 of the bracket 86 (FIG. 7).

As can be seen in FIGS. 2, 3, 5 and 6 the position of the grippers when accepting yarn from the yarn carriers is the same in all cycles of the loom and is determined by the engagement of stop 91 on flange 89 of the bracket 86 with a part of the loom frame. Moreover as the movement of the yarn carriage and gripper shaft is different in successive loom cycles the drive means for the yarn carriage and gripper shaft is adapted to meet that requirement.

It will be appreciated, therefore, from the foregoing description that long and short pile can be produced for successive loom cycles. That of itself would merely produce successive rows of long and short pile in the finished carpet but in accordance with the present invention that is dealt with as follows.

Yarn carriers conventionally carry a plurality of different yarns of different colours and the yarn for any particular pile forming pick is selected by the Jacquard programme. In the present invention one yarn space in each yarn carrier is left empty so that for example if the yarn carriers have eight spaces for pile yarn, only seven pile yarn ends are provided. If the carpet design dictates, for example, that an area of the carpet is to be of high pile then the Jacquard is programmed so that during production of that area of the empty spaces in the relevant yarn carriers are presented to the grippers during each low pile cycle of the loom. In other words in such a case and in 3 shot weaving tufts are inserted every sixth pick in the area in question. When the tufts are beaten-up the gaps between rows of tufts are concealed. Similarly when an area of the carpet is to be in low pile the Jacquard programme is arranged so that during production of that area the empty spaces in the yarn carriers relevant to that area are presented to the grippers during each high pile cycle of the loom. It may happen that the pattern calls for an area of say high pile which does not extend across the entire width of the carpet. It will be evident from the above explanation that in such cases the high and low pile rows of tufts will be staggered relative to each other. However on beating-up the overall impression is of rows of pile with tufts of different length. The density and/or thickness of the pile can be chosen as required in order to achieve the aforesaid impression.

As can be seen from the drawings, the stops may be in the form of bolts threadedly received in tapped bores in the parts which carry them and held in a predetermined position by lock nuts. Thus the length of the stops can be adjusted and that allows the length of high and low pile tufts to be altered also. Furthermore, by appropriate adjustment of the stops the loom can produce carpet in which the tufts in each loom cycle are the same length. In other words the loom can still be used to produce conventional Axminster carpet having a constant pile height.

The arrangement of stops for yarn carriage and gripper shaft has been described with reference to FIG. 1 for one side of the loom only. On wide looms it may be necessary to provide a duplicate set of stops and associated parts on the other side of the loom.

What is claimed is:

1. In a gripper loom for weaving an Axminster pile carpet having a yarn carriage, a yarn carrier on the yarn carriage, and a gripper movable between a tuft collection position and a weaving position, the improvement which comprises first stop means for limiting the travel of the yarn carriage to a first predetermined distance, second stop means for limiting the travel of the yarn carriage to a second predetermined distance, said second distance being less than the first distance, third stop means for limiting movement of the gripper towards the weaving position, fourth stop means for limiting movement of the gripper towards the weaving position to a greater extent than said third stop means, and means for moving said first and second stop means and said third and fourth stop means in timed relation so that when the movement of the yarn carriage is limited by the first stop means the movement of the gripper is limited by the third stop means and when the movement of the yarn carriage is limited by the second stop means the movement of the gripper is limited by the fourth stop means.

2. In a gripper loom, the arrangement defined in claim 1 including means for adjusting said first stop means to permit greater or lesser travel of the yarn carriage when the movement of the latter is being limited by said first stop means, and means for adjusting said second stop means to permit greater or lesser travel of the yarn carriage when movement of the latter is being limited by said second stop means.

3. In a gripper loom the arrangement defined in claim 1 including means for adjusting said third stop means to permit greater or lesser travel of the gripper when movement of the latter is being limited by said third stop means, and means for adjusting said fourth stop means to permit greater or lesser travel of the gripper when movement of the latter is being limited by said fourth stop means.

4. In a gripper loom, the arrangement defined in claim 2 including means for adjusting said third stop means to permit greater or lesser travel of the gripper when movement of the latter is being limited by said third stop means, and means for adjusting said fourth stop means to permit greater or lesser travel of the gripper when movement of the latter is being limited by said fourth stop means.

5. In a gripper loom, the arrangement defined in claim 1 wherein said means for moving said stop means includes cam means, and means for rotating said cam means in timed relation with the main shaft of the loom.

6. In a gripper loom, the arrangement defined in claim 5 wherein said first and second stop means are slidable vertically with respect to the yarn carriage, and including linkage for transmitting movement from said cam means to said first and second stop means to move the latter with respect to the yarn carriage.

* * * * *